US007152339B2

(12) United States Patent
Lo

(10) Patent No.: US 7,152,339 B2
(45) Date of Patent: Dec. 26, 2006

(54) CUSHION CELL FOR SHOES

(76) Inventor: Chie-Fang Lo, No. 11, Alley 7, Lane 715, Dongping Rd., Taiping City, Taichung County (TW)

( * ) Notice: Subject to any disclaimer, the term of this patent is extended or adjusted under 35 U.S.C. 154(b) by 335 days.

(21) Appl. No.: 10/797,116

(22) Filed: Mar. 11, 2004

(65) Prior Publication Data

US 2005/0198862 A1 Sep. 15, 2005

(51) Int. Cl.
*A43B 7/06* (2006.01)

(52) U.S. Cl. ..... 36/3 R; 36/3 B; 36/29; 36/35 B; 36/27

(58) Field of Classification Search ..... 36/25 R, 36/27, 28, 29, 35 R, 3 B
See application file for complete search history.

(56) References Cited

U.S. PATENT DOCUMENTS

| | | | | | |
|---|---|---|---|---|---|
| 337,146 | A | * | 3/1886 | Gluecksmann | 36/7.8 |
| 2,157,912 | A | * | 5/1939 | Nabokin | 36/37 |
| 5,068,981 | A | * | 12/1991 | Jung | 36/3 R |
| 5,224,278 | A | * | 7/1993 | Jeon | 36/29 |
| 5,343,637 | A | * | 9/1994 | Schindler | 36/28 |
| 5,649,374 | A | * | 7/1997 | Chou | 36/27 |
| 6,006,449 | A | * | 12/1999 | Orlowski et al. | 36/27 |
| 6,055,747 | A | * | 5/2000 | Lombardino | 36/37 |

* cited by examiner

*Primary Examiner*—Jila M. Mohandesi

(57) ABSTRACT

A cushion cell for shoes includes a casing with an hour-glass-shaped compressible member received therein which is composed of a spiral wire extending in a vertical direction. The compressible member includes an upper portion and a lower portion, the spiral wire of the upper portion can be inserted in a corresponding spiral gap of the lower portion when the cushion cell is compressed. The distance that the compressible member is compressed is much longer than the chambers in a conventional outsole.

1 Claim, 9 Drawing Sheets

CUSHION CELL FOR SHOES

FIELD OF THE INVENTION

The present invention relates to a cushion cell located between the outsole and insole, and including an hour-glass shaped compressible member which is composed of a spiral wire.

BACKGROUND OF THE INVENTION

A conventional shoe includes an outsole that is generally made of rubber so as to provide proper cushion ability. The conventional outsole is a solid piece and can only be compressed a little bit so that it provides very limited cushion feature. The latest outsole includes a plurality tiny chambers which can be compressed when a load is applied to the outsole. The outsole with tiny chambers can be compressed a distance which is the size of the tiny chambers. However, the distance that can be compressed is so small so that the cushion feature is not satisfied. Besides, the air in the shoe cannot be ventilated and is not healthy for the wearer's foot.

The present invention intends to provide a cushion cell in an outsole of shoes and the cushion cell includes a hour-glass-shaped spring which is composed of a wire so that the spring can be compressed into a flat form and obtain a maximum cushion ability.

SUMMARY OF THE INVENTION

The present invention relates to a cushion cell located between an outsole and an insole of shoes. The cushion cell comprises a casing in which an hour-glass-shaped compressible member is located. The compressible member is composed of an upper portion and a lower portion. Each of the upper portion and the lower portion is a continuously spiral wire that is extended in a vertical direction and includes a narrow end and a wide end. The spiral wire of the upper portion can be inserted in a corresponding spiral gap of the lower portion when the compressible member is compressed into a flat disk-like form.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
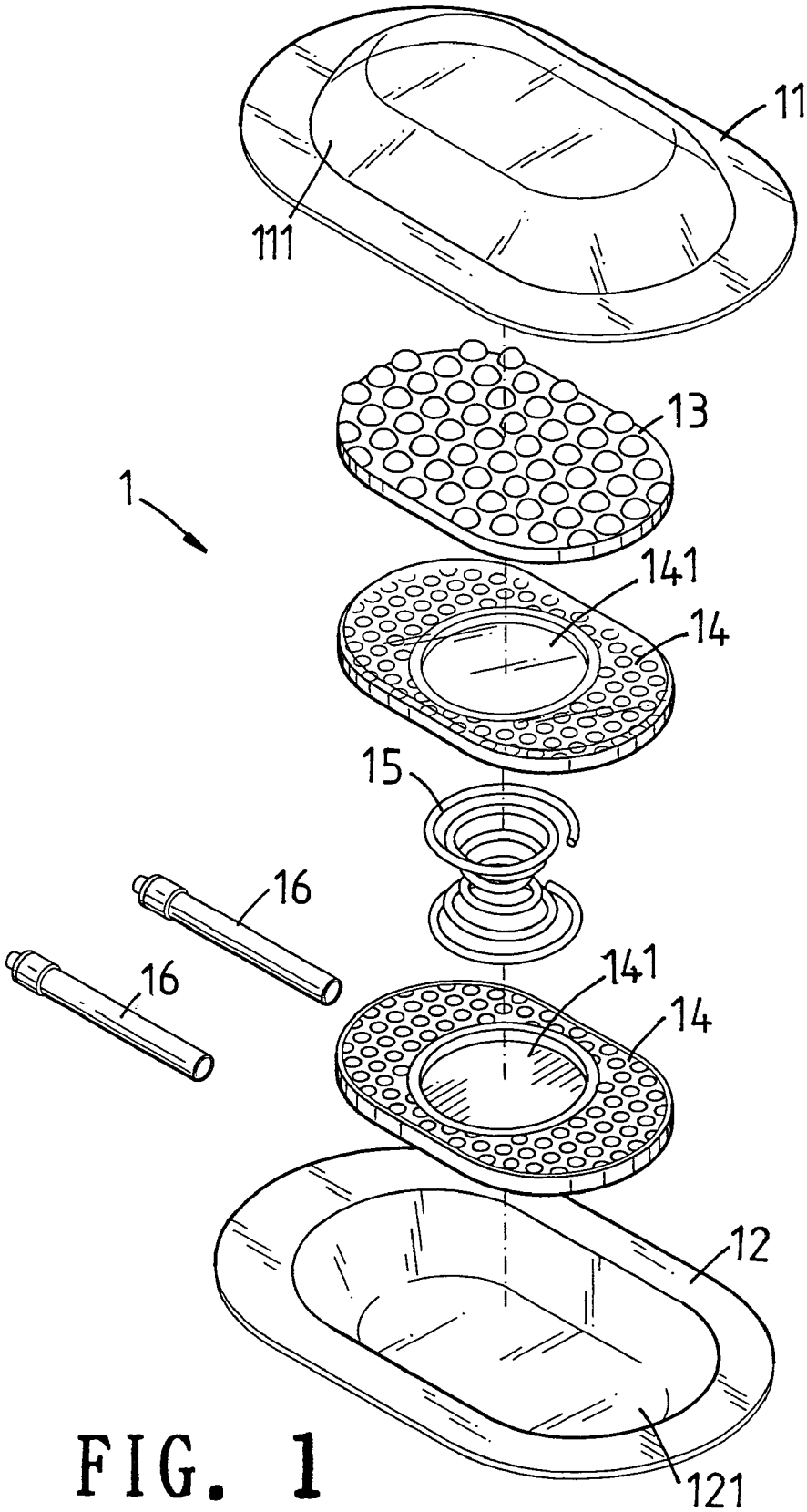
FIG. 1 is an exploded view to show the cushion cell of the present invention.
Figure 2:
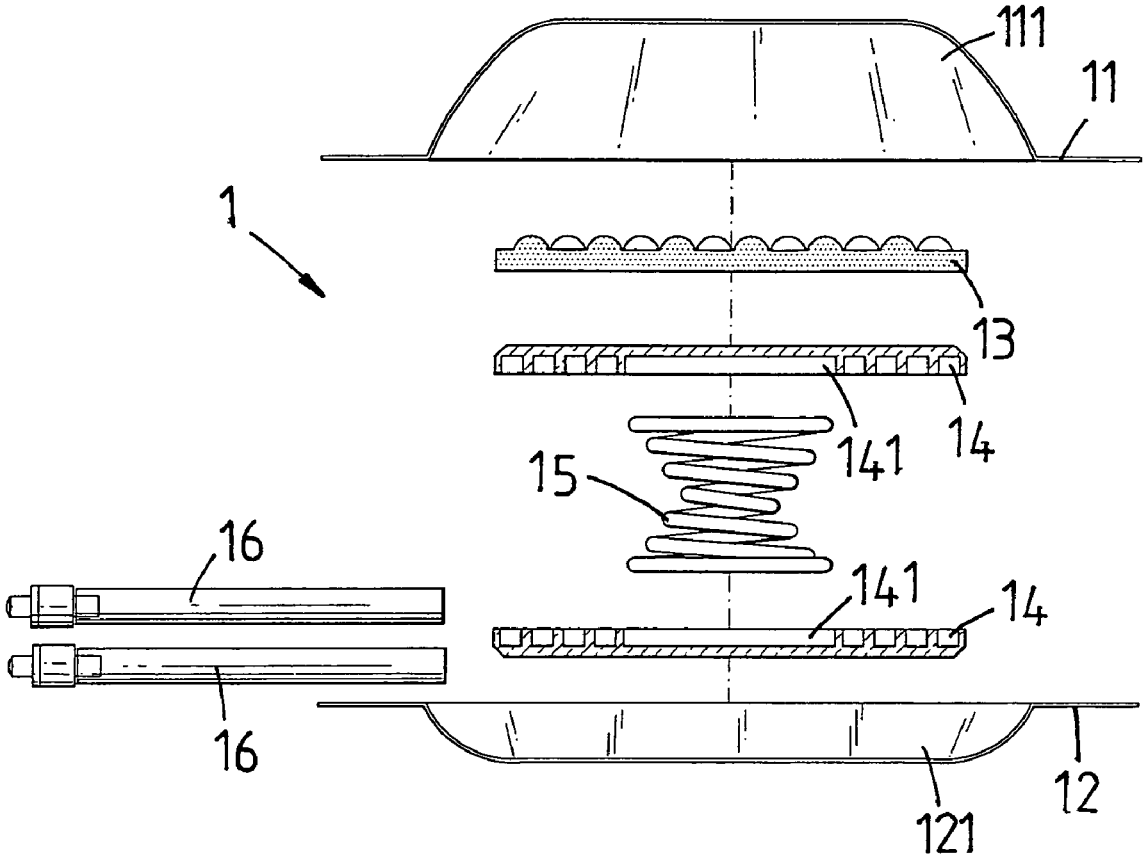
FIG. 2 shows the arrangement of the portions of the cushion cell of the present invention.
Figure 3:
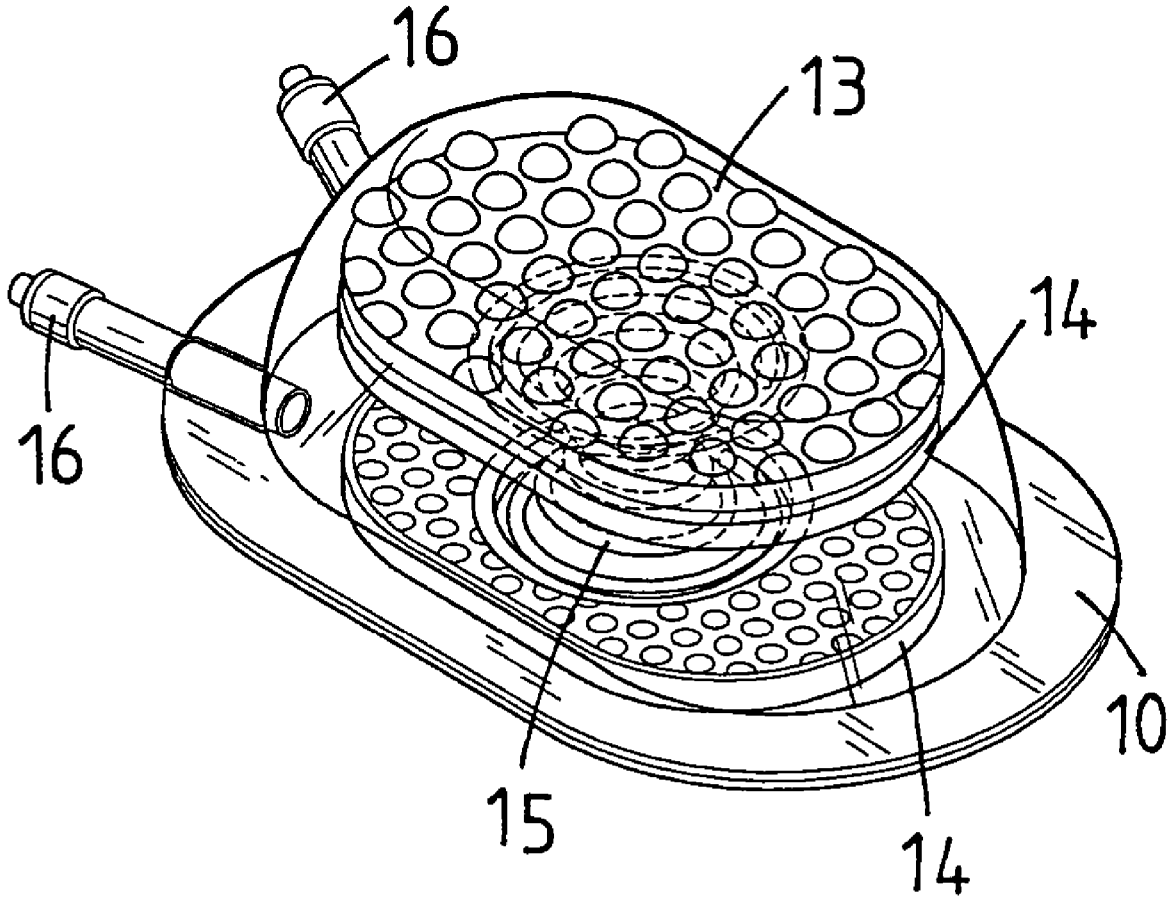
FIG. 3 shows a perspective view of the cushion cell of the present invention.

Referring to FIGS. 1 to 3, the cushion cell 1 of the present invention that is located between an outsole 21 and an inner sole 22 comprises a casing composed of a first portion 11 and a second portion 12. A cushion pad 13, an hour-glass-shaped compressible member 15, and two retaining members 14 are received in a space enclosed of the two respective interior spaces 111 and 121 of the first portion 11 and the second portion 12. The hour-glass-shaped compressible member 15 is composed of an upper portion and a lower portion, each of the upper portion and the lower portion is a continuously spiral wire extended in a vertical direction and including a narrow end and a wide end. The spiral wire of the upper portion can be inserted into a corresponding spiral gap of the lower portion when the compressible member 15 is compressed into a flat disk-like form as disclosed in FIG. 6.

The compressible member 15 is located between the two retaining members 14 and each retaining member 14 has a hole 141 defined therethrough. The two wide ends of the upper portion and the lower portion of the compressible member 15 are engaged with the two respective holes 141 of the two retaining members 14.

Figure 4:
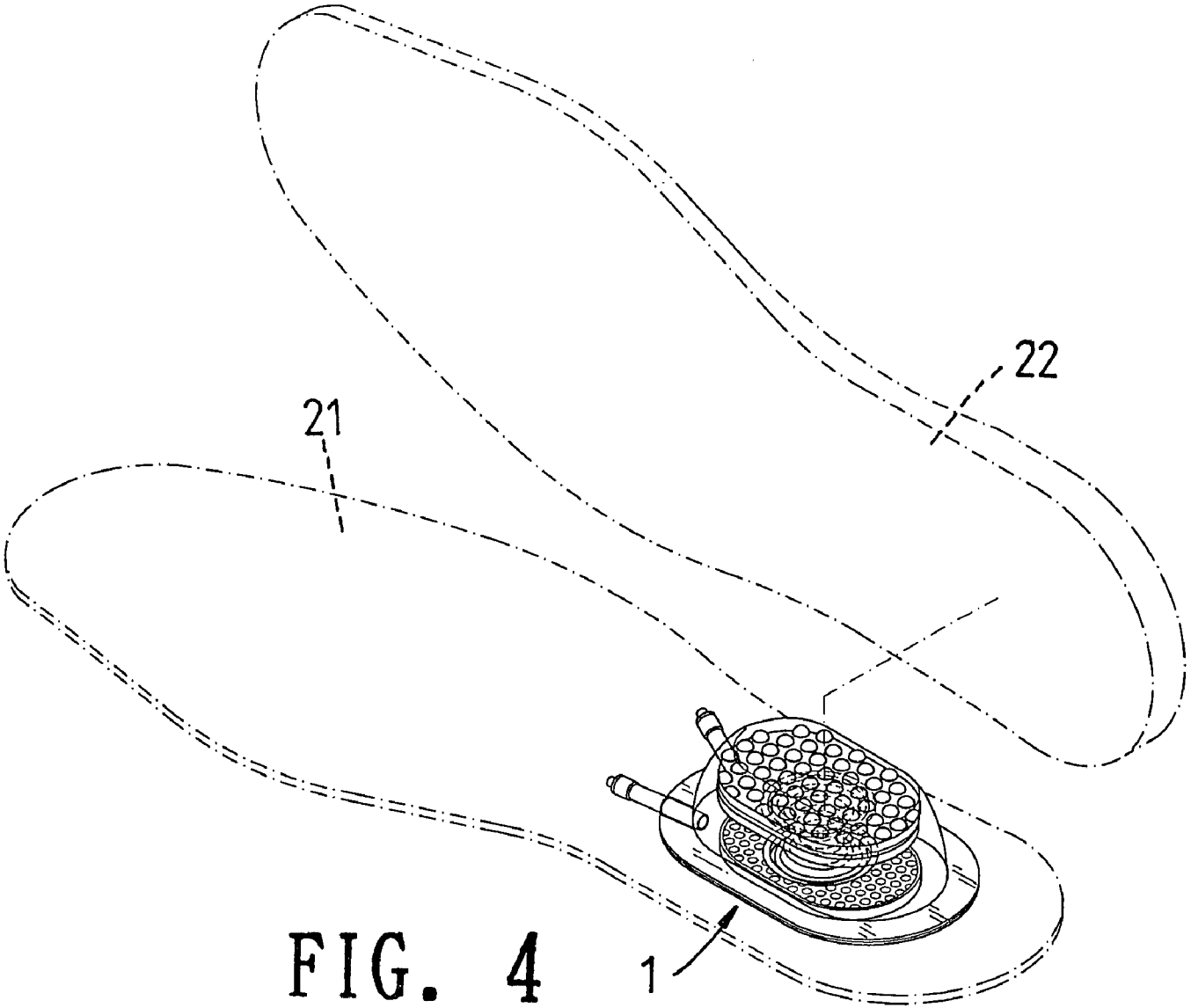
FIG. 4 shows the cushion cell of the present invention is located between the outsole and the insole of shoes.
Figure 5:
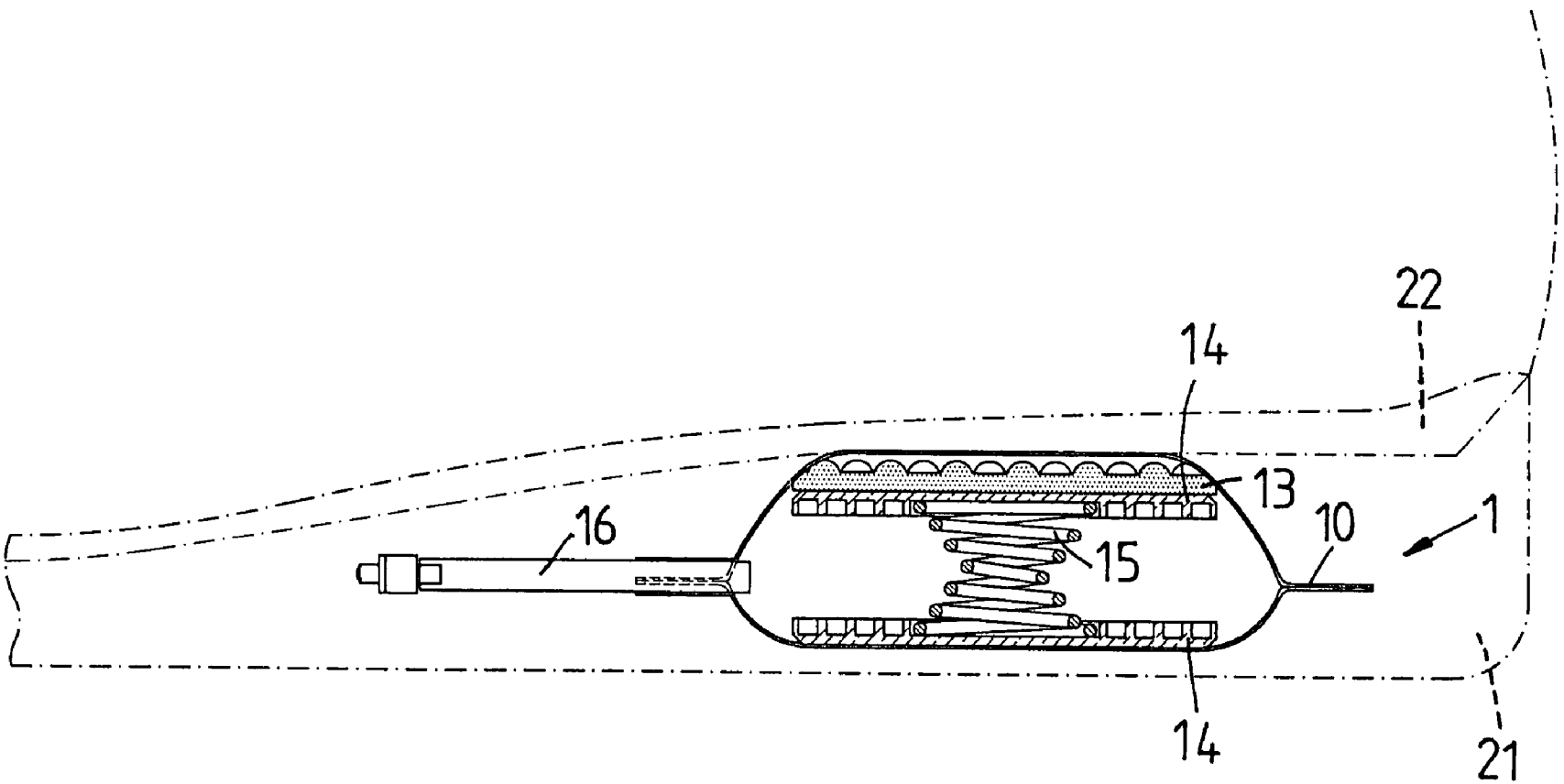
FIG. 5 is a cross sectional view of the cushion cell of the present invention.

The cushion pad 13 is made of foam material and includes a plurality of soft bosses on a top thereof. The cushion pad 13 is put on a top of the retaining member 14 that is close to the inner sole 22 as shown in FIGS. 4 and 5.

Figure 6:
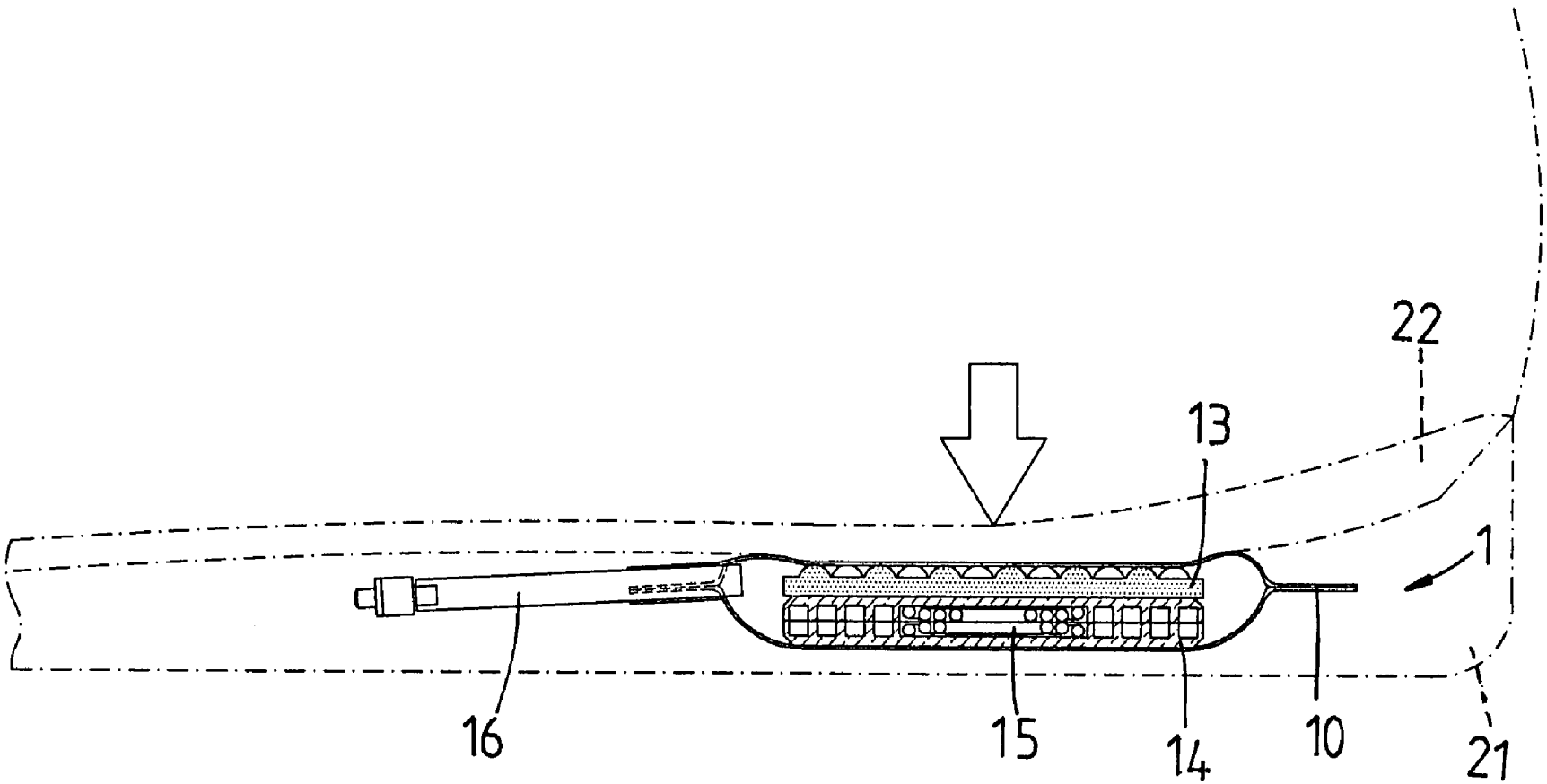
FIG. 6 shows that the hour-glass-shaped compressible member is compressed into a flat disk-like form.

Two ventilation valves 16 each have one end located in the casing and the other end of each of the ventilation valves 16 is located outside of the casing. Therefore, as shown in FIG. 6, when the cushion cell is compressed, the compressible member 15 is compressed as a disk and the air in the casing is expelled via the two ventilation valves 16. When the load is released, the compressible member 15 bounces and air outside of the casing is sucked into the casing. By this way, the air is ventilated and the odor in shoes can be released. The distance that the compressible member 15 is compressed is longer than the chambers in a conventional outsole.

Figure 7:
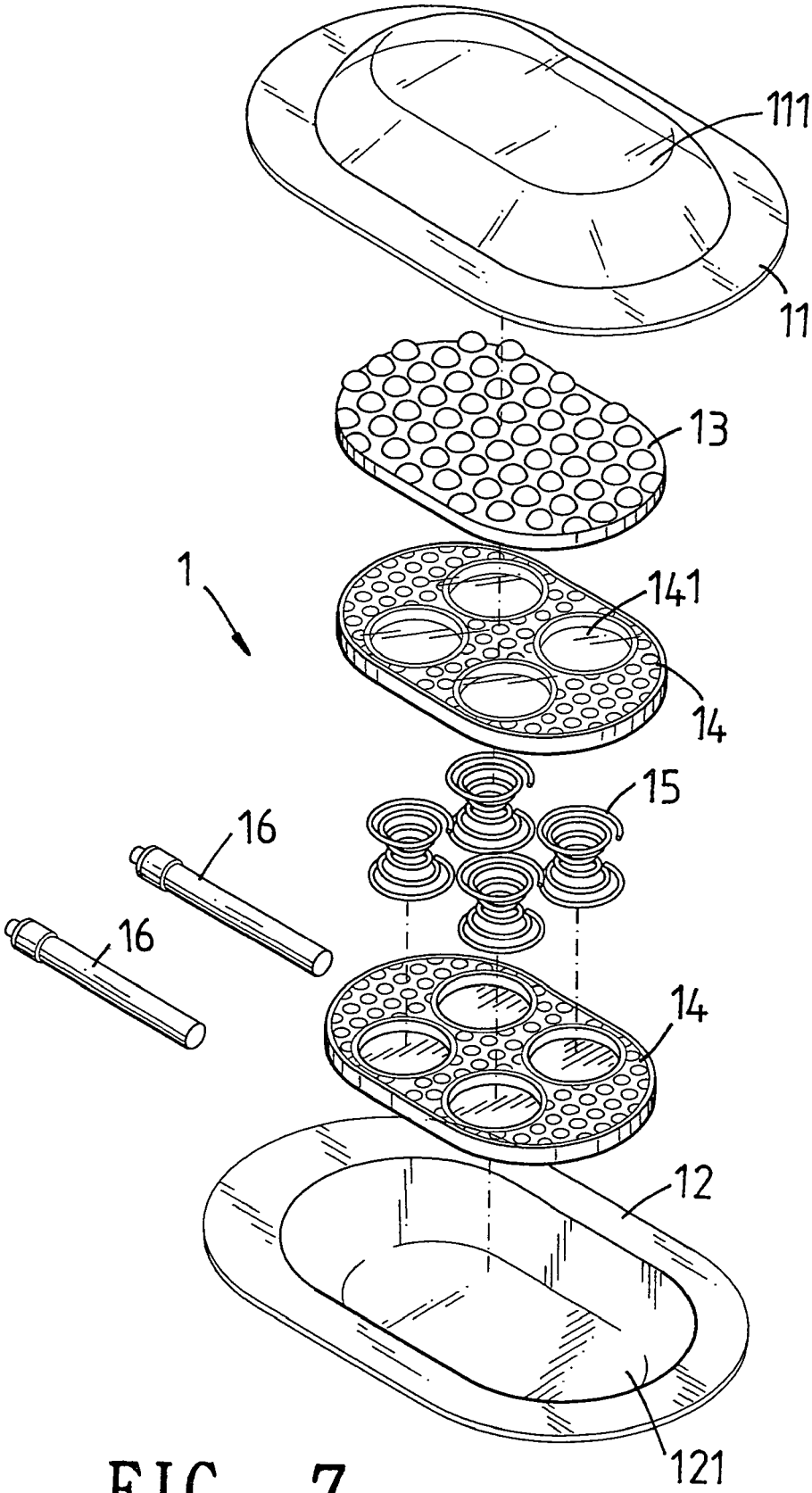
FIG. 7 is an exploded view to show another embodiment of the cushion cell of the present invention.
Figure 8:
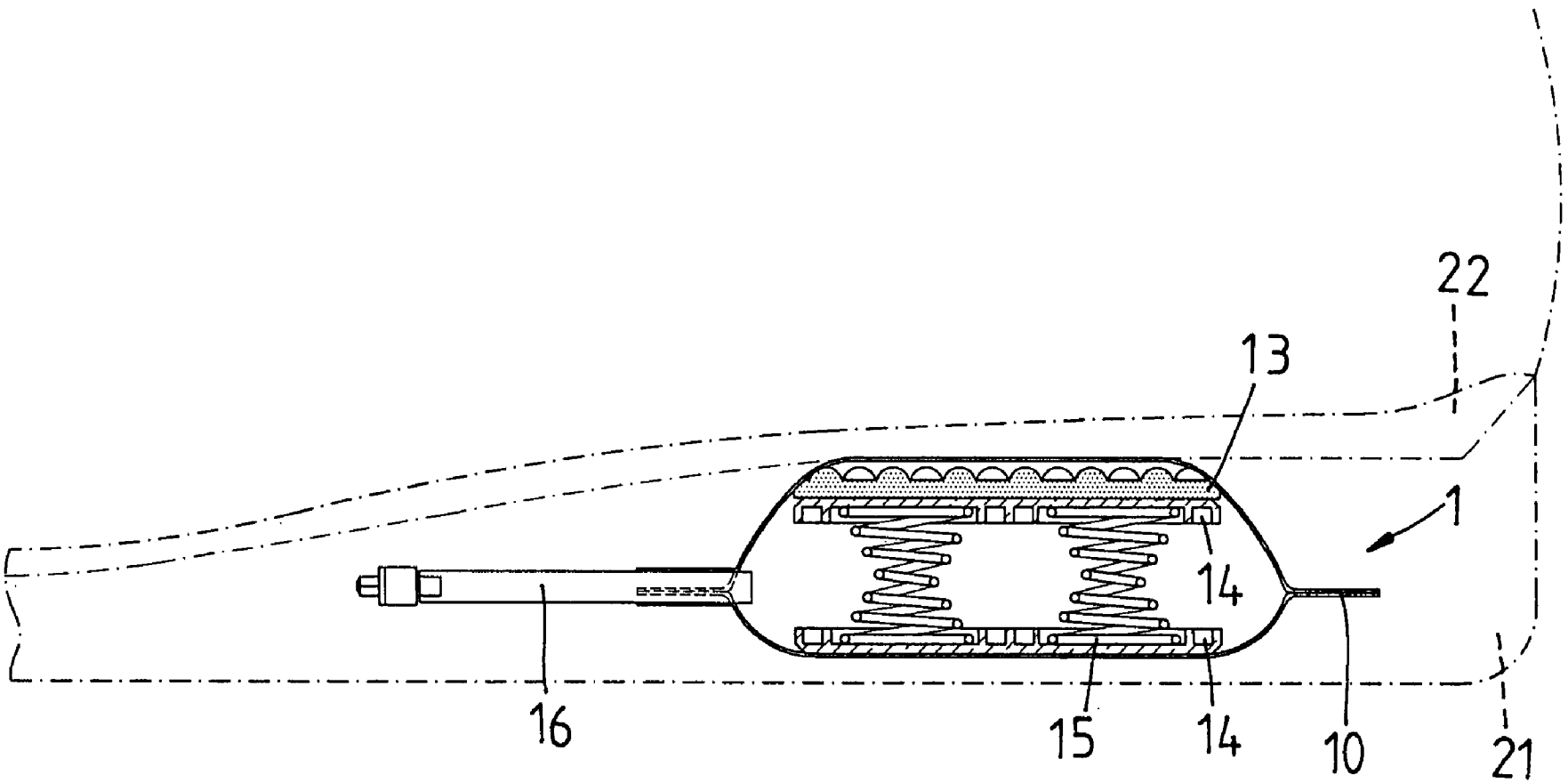
FIG. 8 is a cross sectional view of the cushion cell as shown in FIG. 7 of the present invention.
Figure 9:
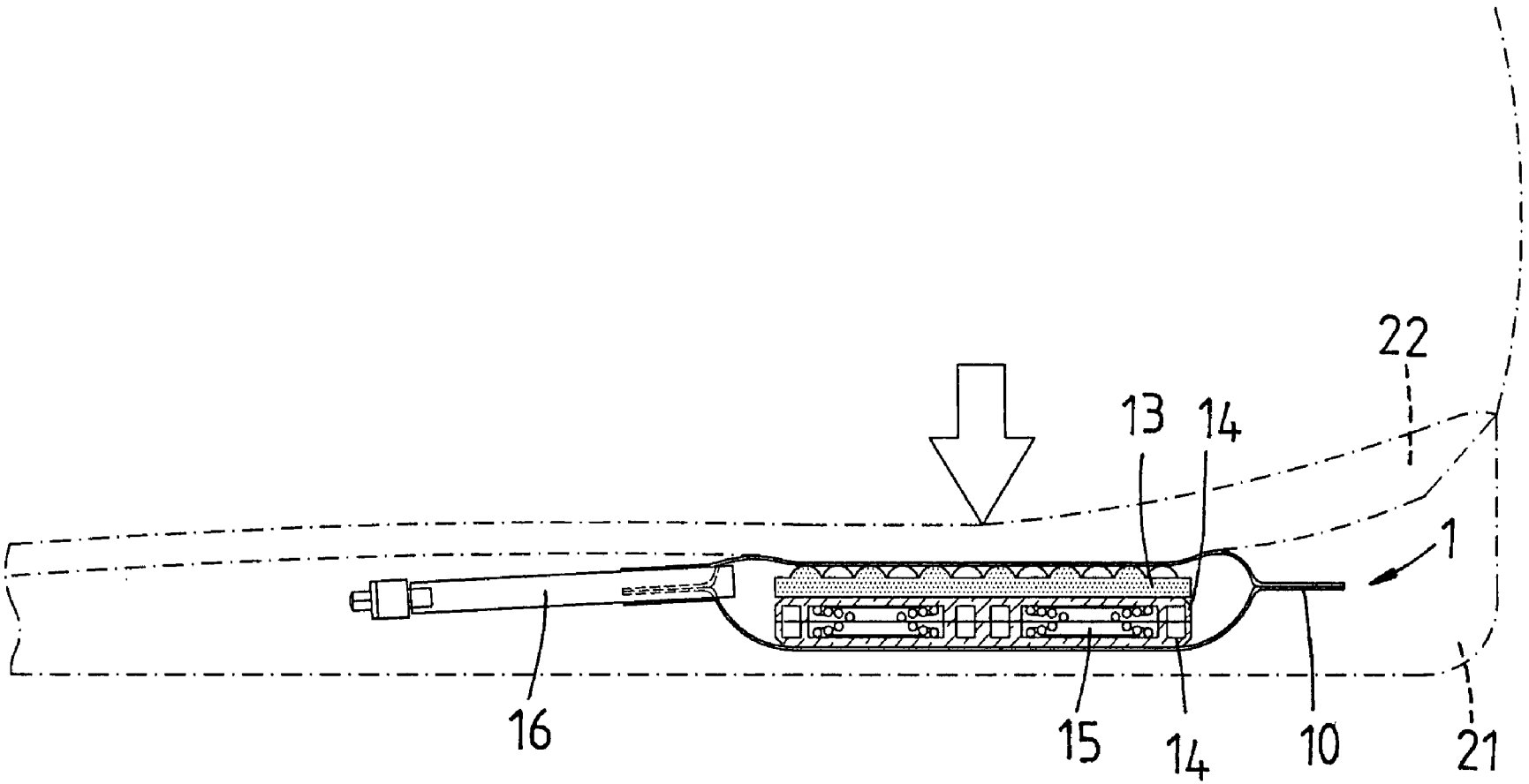
FIG. 9 shows that the hour-glass-shaped compressible member as shown in FIG. 7 is compressed into a flat disk-like form.

Referring to FIGS. 7 to 9, the number of the compressible member 15 can be plural such as four in the embodiment and there are four holes 141 in each of the retaining members 14 to position the four compressible members 15.

While we have shown and described the embodiment in accordance with the present invention, it should be clear to those skilled in the art that further embodiments may be made without departing from the scope of the present invention.

What is claimed is:

1. A cushion cell located between an outsole and an insole of shoes, comprising:

a casing composed of a first portion and a second portion, and an hour-glass-shaped compressible member located in the casing and composed of an upper portion and a lower portion, each of the upper portion and the lower portion being a continuously spiral wire extended in a vertical direction and including a narrow end and a wide end, the spiral wire of the upper portion being inserted in a corresponding spiral gap of the lower portion when the compressible member is compressed into a flat disk-like form, the compressible member located between two retaining members and each retaining member having a hole defined therethrough, two ends of the compressible member being engaged with the two respective holes of the two retaining members;

a cushion pad put on a top of one of the retaining members and being made of foam material, a plurality of soft bosses extending from a top of the cushion pad, and at least one ventilation valve which has one end located in the casing and the other end of the at least one ventilation valve located outside of the casing.

* * * * *